US008336981B2

(12) United States Patent
Chen et al.

(10) Patent No.: US 8,336,981 B2
(45) Date of Patent: Dec. 25, 2012

(54) DETERMINING A HEALTHY FLUID EJECTION NOZZLE

(75) Inventors: Chien-Hua Chen, Corvallis, OR (US); Donald W. Schulte, Albany, OR (US); Terry Mcmahon, Albany, OR (US); Ying-Chih Liao, Taipei (TW); David D. Hall, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 597 days.

(21) Appl. No.: 12/575,943

(22) Filed: Oct. 8, 2009

(65) Prior Publication Data

US 2011/0084997 A1 Apr. 14, 2011

(51) Int. Cl.
*B41J 29/38* (2006.01)

(52) U.S. Cl. ..... 347/14; 73/304 C

(58) Field of Classification Search ..... 347/14, 347/19; 73/304 R, 304 S, 304 C; 346/104, 346/140

See application file for complete search history.

(56) References Cited

U.S. PATENT DOCUMENTS

| | | | | |
|---|---|---|---|---|
| 4,241,357 | A * | 12/1980 | Anestos | 347/23 |
| 5,912,685 | A * | 6/1999 | Raman | 347/65 |
| 6,481,831 | B1 * | 11/2002 | Davis et al. | 347/62 |
| 6,764,168 | B1 * | 7/2004 | Meinhold et al. | 347/81 |
| 6,910,377 | B1 * | 6/2005 | Richter et al. | 73/290 R |
| 2002/0001020 | A1 | 1/2002 | Mrvos et al. | |
| 2003/0085957 | A1 | 5/2003 | Huang et al. | |
| 2003/0128255 | A1 | 7/2003 | Huang et al. | |
| 2008/0043065 | A1 * | 2/2008 | Nielsen et al. | 347/63 |
| 2008/0211847 | A1 | 9/2008 | Shamoun | |
| 2008/0225088 | A1 | 9/2008 | Chung et al. | |

* cited by examiner

*Primary Examiner* — Charlie Peng
*Assistant Examiner* — Peter Radkowski
(74) *Attorney, Agent, or Firm* — Nathan R. Rieth

(57) ABSTRACT

A method of determining a healthy fluid ejection nozzle includes measuring changes in impedance across the nozzle as fluid passes through it. A printhead includes a metal probe that intersects an ink nozzle and an integrated circuit to sense a change in impedance across the nozzle through the metal probe.

11 Claims, 11 Drawing Sheets

DETERMINING A HEALTHY FLUID EJECTION NOZZLE

BACKGROUND

Conventional drop-on-demand inkjet printers are commonly categorized based on one of two mechanisms of drop formation. A thermal bubble inkjet printer uses a heating element actuator in an ink-filled chamber to vaporize ink and create a bubble which forces an ink drop out of a nozzle. A piezoelectric inkjet printer uses a piezoelectric material actuator on a wall of an ink-filled chamber to generate a pressure pulse which forces a drop of ink out of the nozzle. Inkjet printers can also be categorized as multi-pass or single-pass printers. In multi-pass, or scanning-carriage inkjet printing systems, printheads are mounted on a carriage that moves back and forth across stationary print media as the printheads deposit or eject ink droplets to form text and images. The print media advances when the printheads complete a "print swath", which is typically an inch or less in height. In single-pass, or page wide array inkjet printing systems, multiple printhead dies are configured in a printhead module called a "page wide array". Thus, print swaths spanning an entire page width or a substantial portion of a page width are possible, which significantly increases the print speed of inkjet printers.

Monitoring the health of ink nozzles in the printheads is an important part of maintaining print quality in the thermal bubble, piezoelectric, scanning-carriage, and page wide array printers. Incorrect amounts of ink and inaccurate placement of ink on media by non-functioning nozzles can contribute to print quality defects. Causes for non-functioning nozzles include, for example, internal and external jetting head contamination, vapor bubbles within the jetting head, crusting of ink over the nozzles, a failure to activate the ink ejection element (e.g., resistive heating actuator, piezoelectric material actuator), etc.

Various methods of detecting failed nozzles have been developed. For example, sensors have been used in the past to detect whether a droplet has been ejected from a nozzle. In one method, a photo-diode and a light emitting diode (LED) sensor pair is used to detect the shadow of a droplet passing between the photo-diode and the LED. In another method, a piezo electric film is used as a droplet target to detect whether or not a droplet impacts the target. In another method, an electrostatic sensor detects a positive or negative charge from an ejected droplet. In yet another method, piezo-electric crystals are used to detect the acoustic signature generated as a droplet is ejected from the printhead.

Unfortunately, these and other methods of detecting failed nozzles have limitations. For example, such methods are unable to detect failed nozzles "on-the-fly" during normal fluid ejection activities, such as during printing. Because nozzle health can change during a print job or other fluid ejection routine, the inability to detect non-functioning nozzles on-the-fly (i.e., during a print job or other fluid ejection activity) can result in significant problems and added costs. This is especially true with page wide array printing systems used for large format or industrial printing applications. Page wide array printers often print extensive, long-run, roll-fed print jobs that can incur significant costs if the print jobs are interrupted to locate and correct non-functioning nozzles.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview of Problem and Solution

Figure 1:
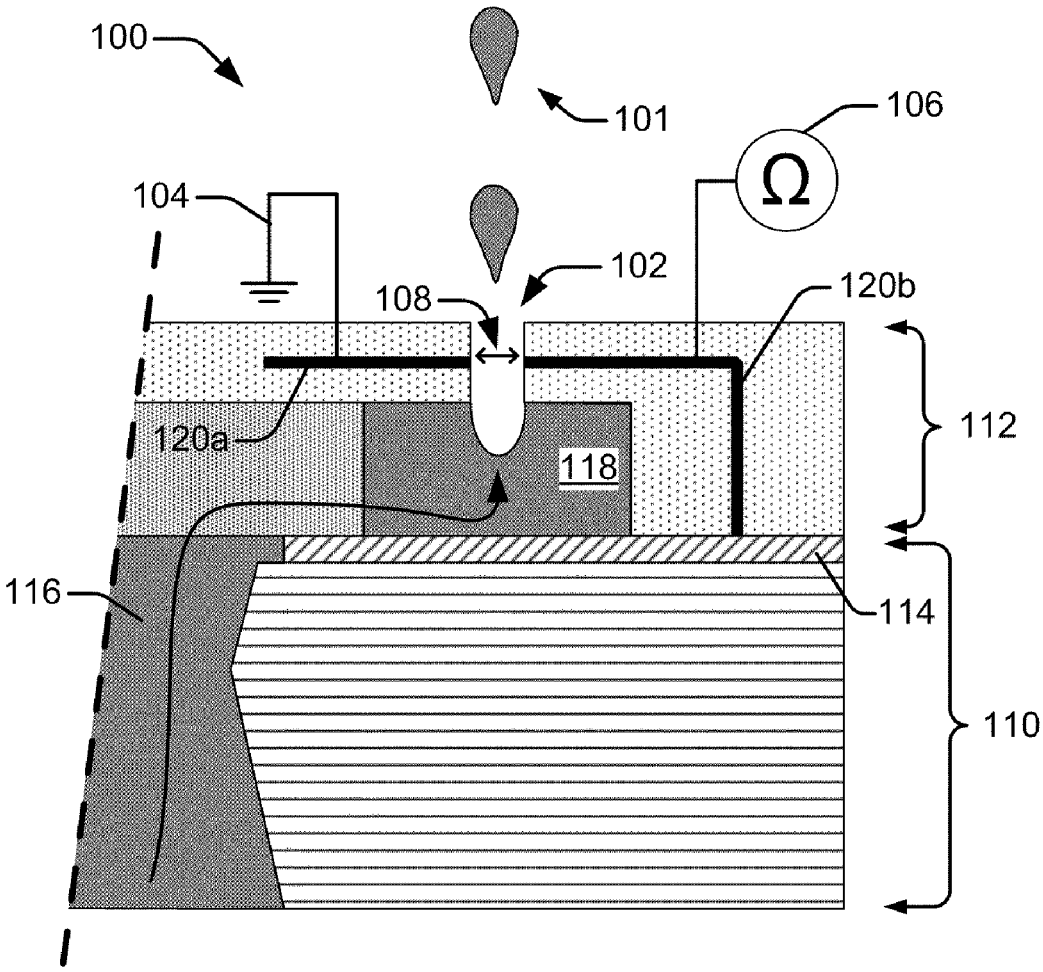
FIG. 1 shows a partial illustration of an example of a fluid ejection head configured to determine the health of a fluid nozzle by sensing changes in impedance across the nozzle according to an embodiment.

As noted above, monitoring the health of ink nozzles in the printheads of inkjet printers is an important part of maintaining print quality. Furthermore, because nozzle health can change during printing, the ability to detect non-functioning nozzles on-the-fly, such as during printing, provides an advantage over having to take a printer offline to detect and compensate for non-functioning nozzles. This is especially true with printing systems such as single-pass or "page wide array" systems used for large format or industrial printing applications where interrupting long-run print jobs to locate and correct for non-functioning ink nozzles can result in costly delays. Consequently, for page wide array printing systems, maintaining nozzle health often amounts to running scheduled diagnostic procedures offline, or to time-based replacement of all the ink pens (e.g., replacing ink pens every 3 days).

One example of a diagnostic procedure used to detect non-functioning nozzles begins with printing a diagnostic test page. The diagnostic page is examined for print quality deficiencies to determine the approximate locations of nozzles that may be non-functioning. Adjustments can then be made to compensate for suspected bad nozzles in order to improve the print quality. Adjustments can include, for example, replacing printheads containing nozzles thought to be non-functioning, servicing nozzles thought to be non-functioning, using redundant nozzles, and changing the drop weights in nozzles adjacent to suspected bad nozzles. In some systems, a diagnostic test page can be scanned directly back into the printer, which then generates a calibration table used to compensate for print quality deficiencies. Using the calibration table, the printer can compensate for suspected bad nozzles which may be causing print quality deficiencies found in the diagnostic page. Disadvantages with this method of detecting and compensating for non-functioning nozzles are that it does not detect precisely which nozzles are non-functioning, and it is a time consuming and complicated process. The main disadvantages with the simple time-based replacement of ink pens mentioned above, is that it is wasteful and expensive.

Embodiments of the present disclosure overcome disadvantages such as those mentioned above through performance-based maintenance that monitors nozzle health in-situ (i.e., during nozzle operation). Individual, non-functioning nozzles are detected in real time, making it possible to compensate for non-functioning nozzles during printing through, for example, turning on redundant nozzles or increasing the output of adjacent nozzles. In general, the embodiments provide a nozzle, such as an inkjet nozzle, configured to sense a fluid drop (e.g., an ink drop) as it is ejected through the nozzle by sensing changes in impedance across the nozzle. In one embodiment, for example, a method of determining a healthy fluid ejection nozzle includes measuring changes in impedance across the nozzle as fluid passes through it. In another embodiment, a printhead includes a metal probe that intersects an ink nozzle and an integrated circuit to sense a change in impedance across the nozzle through the metal probe. In another embodiment, a method of fabricating an inkjet printhead includes forming an SU8 orifice layer that includes a chamber and a nozzle, forming a top SU8 layer over the SU8 orifice layer, and forming a metal trace on the top SU8 layer to intersect the nozzle at a first end and extend to an edge of a die at a second end.

Illustrative Embodiments

FIG. 1 shows a partial illustration of an example fluid ejection head 100 (e.g., an inkjet printhead) configured to determine the health of a fluid nozzle 102 by sensing changes in impedance across the nozzle as a fluid ejection event occurs, according to an embodiment. In FIG. 1, a circuit ground symbol 104 and an ohmmeter symbol 106 are included to help illustrate the basic method of measuring the impedance across the nozzle gap 108, as discussed in detail below.

One embodiment of a fluid ejection head 100 is an inkjet printhead 100 in an inkjet printing system (not shown). In general, and as well-known to those skilled in the art, an inkjet printhead 100 ejects ink droplets 101 through a plurality of orifices or nozzles toward a print medium, such as a sheet of paper, to print an image onto the print medium. The nozzles are typically arranged in one or more arrays, such that properly sequenced ejection of ink from the nozzles causes characters or other images to be printed on the print medium as the printhead and the print medium are moved relative to each other.

In general, the operating mechanism of a conventional inkjet printhead 100 can be classified into thermal bubble and piezoelectric. In a typical thermal bubble inkjet printing system, the printhead ejects ink drops through nozzles by rapidly heating small volumes of ink located in ink chambers. The ink is heated with small electric heaters, such as thin film resistors sometimes referred to as firing resistors. Heating the ink causes the ink to vaporize and be ejected through the nozzles. In a piezoelectric inkjet printing system, the printhead ejects ink drops through nozzles by generating pressure pulses in the ink within the chamber, forcing drops of ink from the nozzle. The pressure pulses are generated by changes in shape or size of a piezoelectric material when a voltage is applied across the material. Although reference is made herein primarily to a conventional inkjet printhead 100 of the thermal bubble or piezoelectric type, it is noted that printhead 100 may comprise any other type of device configured to selectively deliver or eject a fluid onto a medium through a nozzle.

Referring again to FIG. 1, the inkjet printhead 100 generally includes a substrate layer such as a silicon substrate 110, and an orifice layer 112. An integrated circuit layer 114 is fabricated on the silicon substrate 110 between the substrate 110 and the orifice layer 112. The substrate 110 includes an ink channel 116 for supplying ink or other fluid to the orifice layer 112 and nozzle(s) 102. The orifice layer 112 is an SU-8 layer that includes a chamber 118 (e.g., an ink firing chamber) and nozzle 102. Also included in the SU-8 orifice layer 112 are embedded conductor traces 120. The embedded conductor traces 120 intersect nozzle 102 and operate as a pair of probes for the general purpose of sensing changes in impedance across the gap 108 in nozzle 102 as droplets 101 are ejected from the nozzle 102. The embedded conductor traces 120 are electrically coupled to integrated circuitry 114 (on silicon substrate 110) which is configured to measure and analyze changes in impedance sensed through the conductor traces 120.

Figure 2:
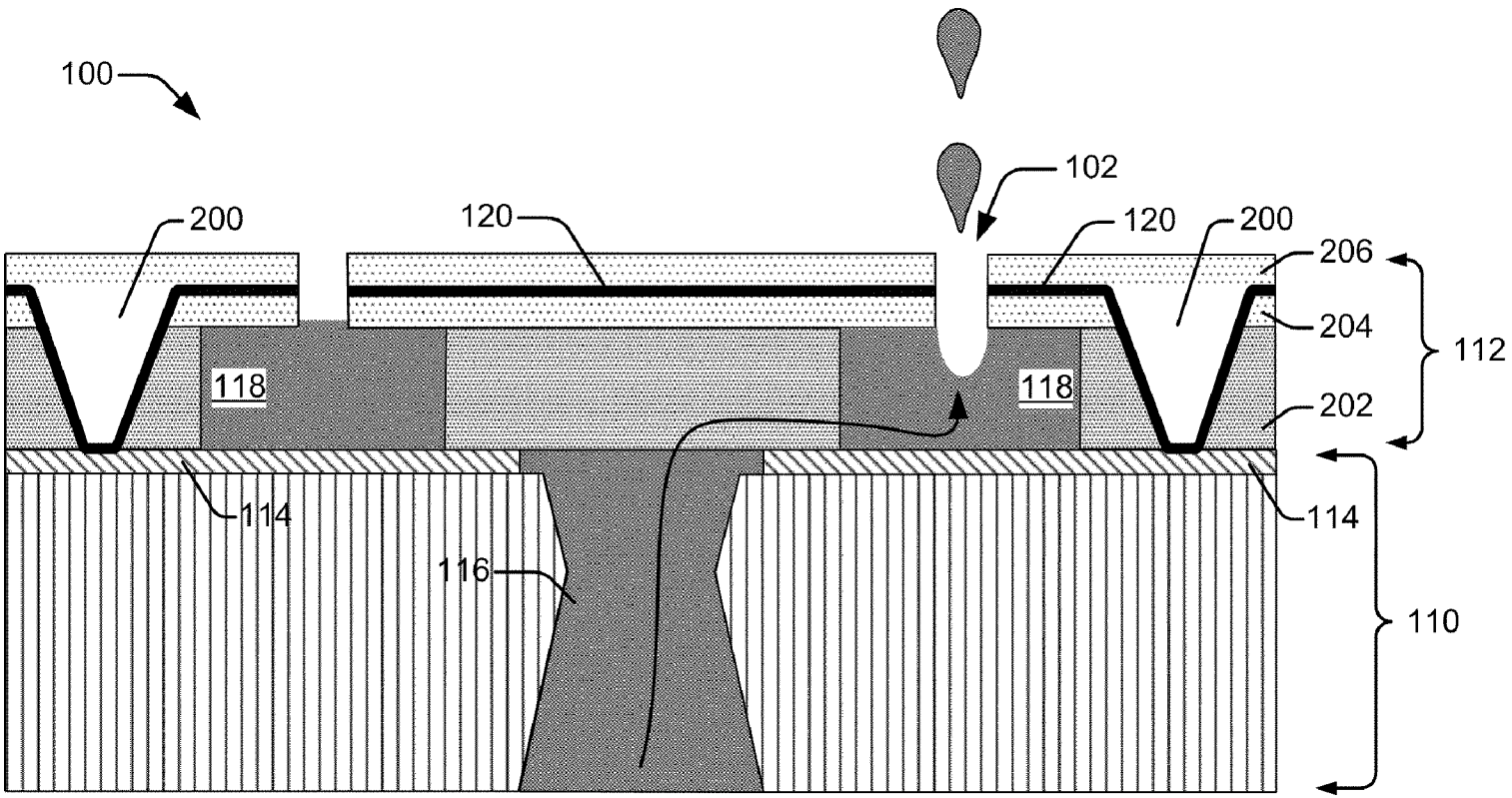
FIG. 2 shows an example of an inkjet printhead that includes vias formed through an SU-8 orifice layer according to an embodiment.

In some embodiments the embedded conductor traces 120 travel from the nozzle 102 to the integrated circuitry 114 on the silicon substrate 110 through vias formed in the SU-8 orifice layer 112. For example, in the embodiment shown in FIG. 2, an inkjet printhead 100 includes vias 200 formed through the SU-8 orifice layer 112 that permit the embedded conductor traces 120 to pass through the SU-8 orifice layer 112 and contact integrated circuitry 114 on the silicon substrate 110. In addition, in the FIG. 2 embodiment, a distinction is apparent within the SU-8 orifice layer 112 which is intended to illustrate that the SU-8 orifice layer 112 may be composed of more than a single layer of SU-8. As shown in the FIG. 2 embodiment, the SU-8 orifice layer 112 may be composed of a first chamber layer 202, a second "top-hat" layer 204, and a third "cap" layer 206. In this configuration the embedded conductor traces 120 are embedded within the SU-8 orifice layer 112 between the top-hat layer 204 and cap layer 206.

Figure 3:
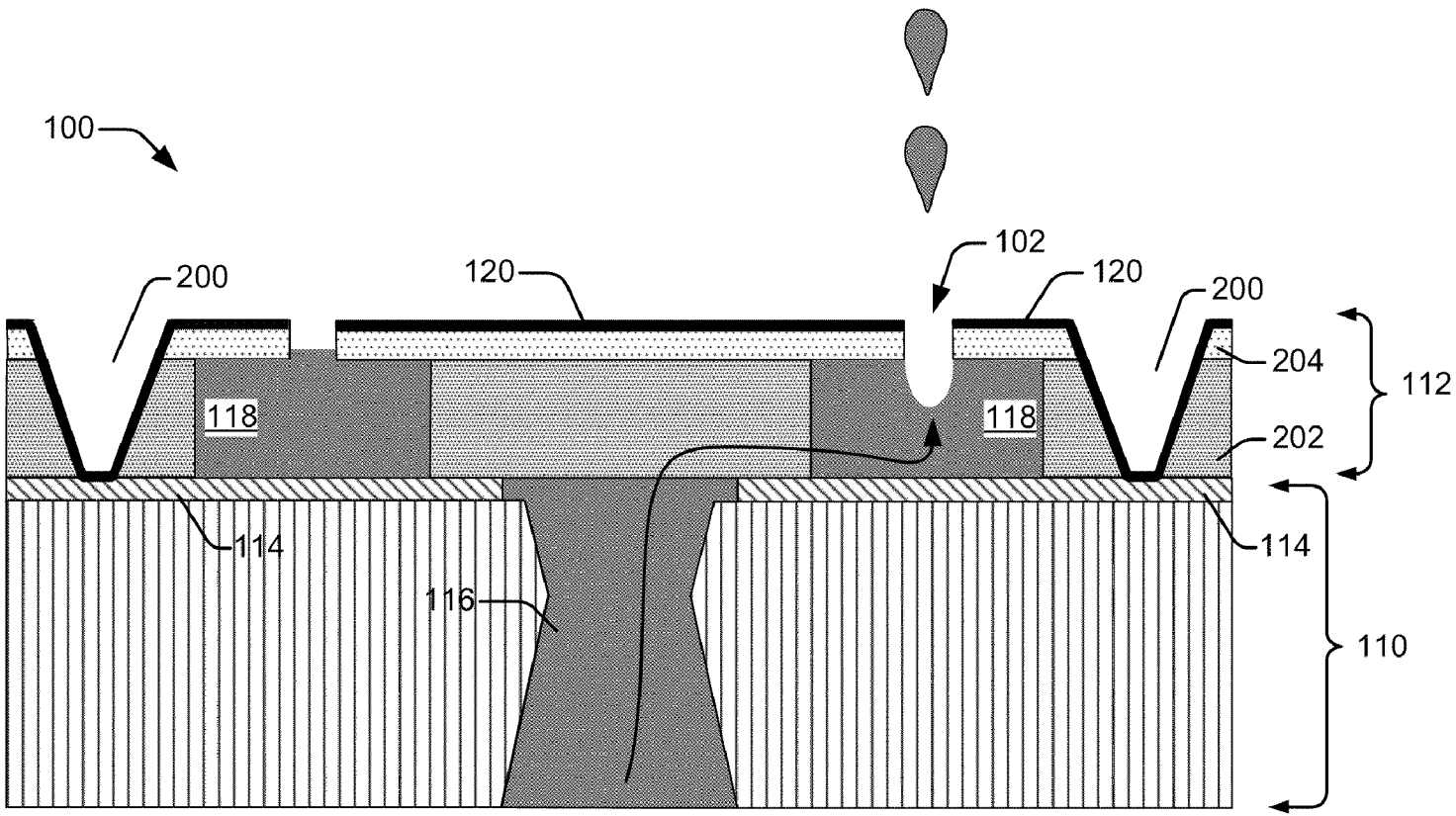
FIG. 3 shows an example of an inkjet printhead with embedded conductor traces formed on top of a top-hat layer according to an embodiment.

In another embodiment, as shown in FIG. 3, the embedded conductor traces 120 can also be placed on top of the top-hat layer 204, without a cap layer 206. In general, depending on the fabrication process flow, the conductor traces 120 can be placed variously within the SU-8 orifice layer 112, such as beneath the top-hat layer 204, inside the top-hat layer 204, between the top-hat layer 204 and a cap layer 206, or on top of the top-hat layer 204 without a cap layer 206. In addition, the shape of the conductor traces 120 can be defined (e.g., photo-defined, etc.) in the fabrication process so that it is possible to make traces with different sizes, lengths, and shapes.

Figure 4:
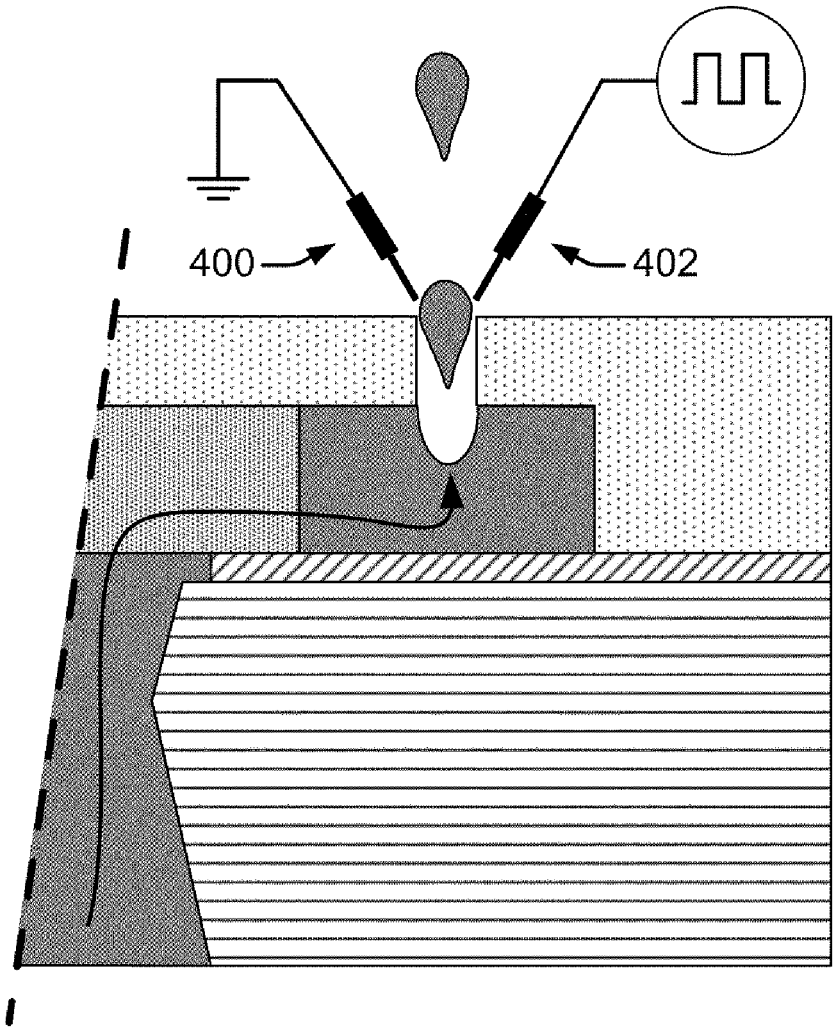
FIG. 4 shows an example of an inkjet printhead illustrating conductor traces acting as probes to measure changes in impedance according to an embodiment.

Referring now to FIGS. 1 and 4, the general process of measuring changes in impedance across a nozzle 102 will be discussed. As noted above, the circuit ground symbol 104 and ohmmeter symbol 106 shown in FIG. 1 help to illustrate a basic method of measuring changes in impedance across the nozzle gap 108. A circuit is formed through the nozzle 102 between a first conductor trace **120*a* intersecting a first side of nozzle 102 and coupled to ground (e.g., through integrated circuitry layer 114, FIGS. 1-3), and a second conductor trace 120*b* intersecting a second side of nozzle 102 and coupled to a fixed voltage potential at the integrated circuitry layer 114. FIG. 4 provides an additional illustration of how the conductor traces 120 act as probes in the circuit to measure changes in impedance as droplets 101 are ejected from the nozzle 102, according to an embodiment. A first probe 400 represents the first conductor trace 120*a* (FIG. 1) coupled to ground, and a second probe 402 represents the second conductor trace 120*b* (FIG. 1) coupled to a fixed potential on the integrated circuitry 114. As a droplet 101 is ejected from nozzle 102, fluctuations in current flowing across the nozzle 102 are sensed, which enables a measurement of changes in the impedance across the nozzle 102**.

Figure 5:
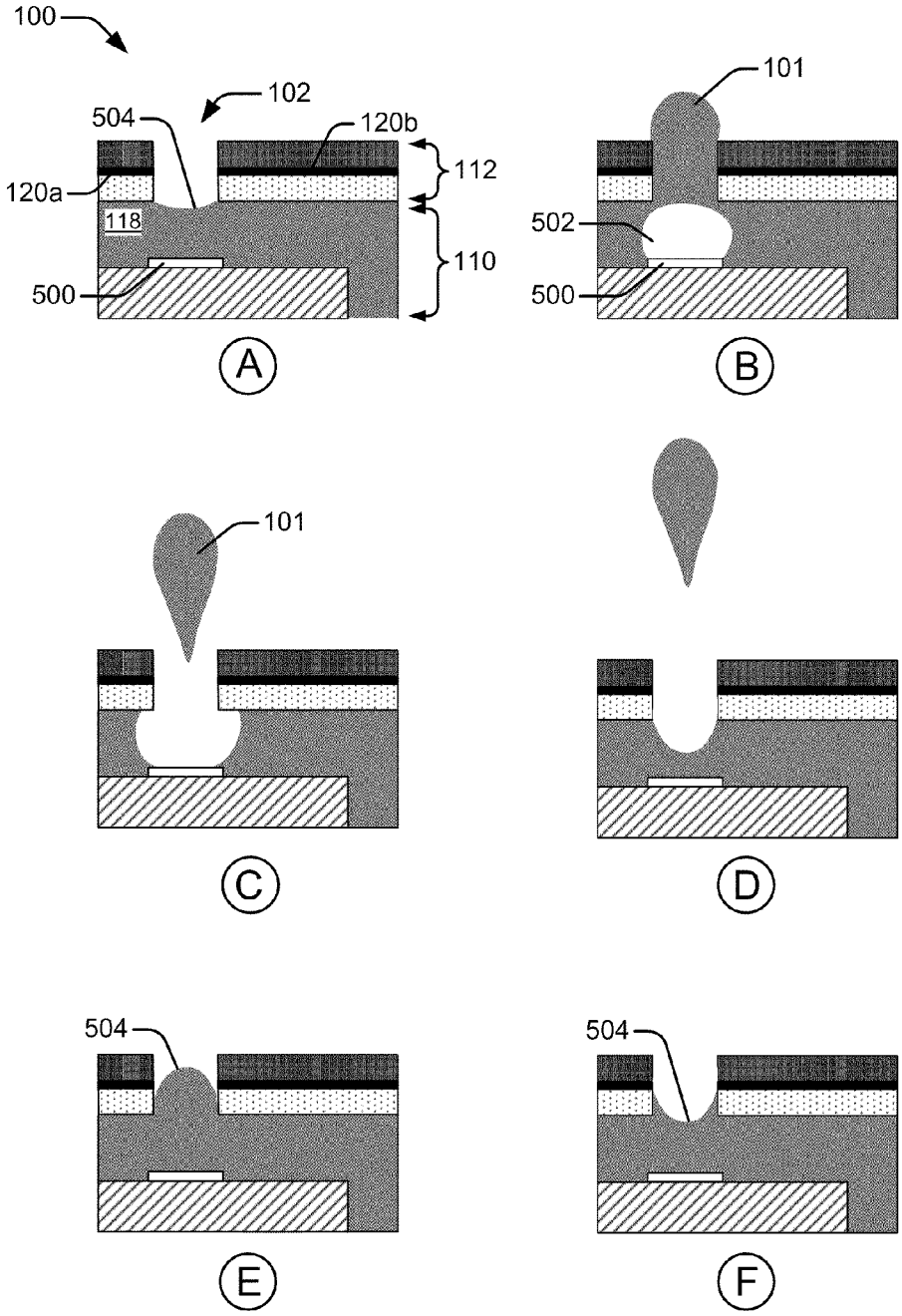
FIG. 5 shows an example of a drop of fluid being ejected from an inkjet printhead in a series of progressing illustrations, according to an embodiment.
Figure 6:
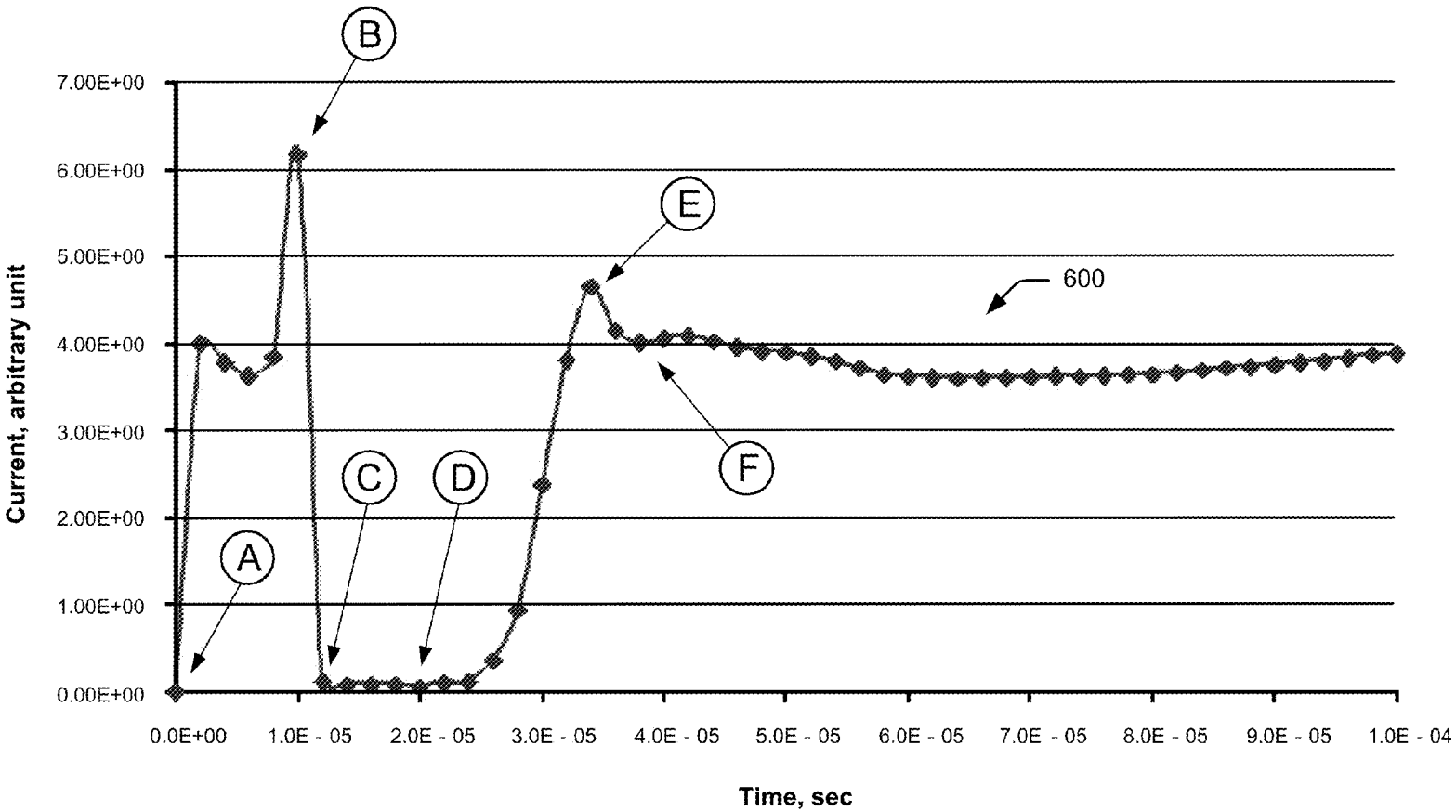
FIG. 6 shows an example of a plot of current versus time of current that flows through conductor traces before, during and after and ink drop ejection, according to an embodiment.

Referring additionally now to FIGS. 5 and 6, an example of the process of measuring changes in impedance across a nozzle 102 as a droplet 101 is ejected from the nozzle 102 will be discussed. FIG. 5 shows an example of a drop of fluid being ejected from an inkjet printhead 1001*n* a series of progressing illustrations (A-F), according to an embodiment. Although reference numbers are included on only several of the illustrations of FIG. 5, such reference numbers apply to similar or identical elements shown in all of the illustrations A-F of FIG. 5. Furthermore, although the inkjet printhead 100 of FIG. 5 implements a thermal bubble drop formation mechanism, it may also implement a piezoelectric material mechanism or some other mechanism to form and eject a droplet 101 from nozzle 102. The inkjet printhead 100 of FIG. 5 uses a heating element actuator 500 in an ink-filled chamber 118 to vaporize ink and create a bubble 502 which forces an ink drop 101 out of nozzle 102. Before, during and after the drop 101 is ejected from nozzle 102, a varying amount of ink within the nozzle 102 results in a changing impedance between conductor traces 120*a* and 120*b* intersecting either side of nozzle 102.

As shown in illustration A of FIG. 5, prior to the start of the drop ejection there is no vapor bubble 502 in chamber 118 and no ink in the nozzle 102. At this time, the ink forms a meniscus 504 in chamber 118 that rests at or near the entry to the nozzle 102. In illustration B, the heating element 500 has been actuated, causing the formation of a vapor bubble 502. The expanding vapor bubble 502 forces ink through the nozzle 102 which causes the formation of an ink droplet 101. In illustration C, the ink droplet 101 has cleared the nozzle 102, and the void of ink created in chamber 118 from the ejected ink begins to be refilled with ink. At this time, it is apparent that there is no ink in the nozzle 102. Illustrations D, E, and F show the chamber 118 being refilled with ink and the fluctuation of the ink meniscus 504 as the chamber 118 refills with ink. In illustration D, the chamber 118 is almost full again and the meniscus 504 is advancing toward the entry to the nozzle 102. In illustration E, the momentum of the ink refilling chamber causes the ink meniscus 504 to advance somewhat into the nozzle 102. In illustration F, the ink meniscus 504 retreats back toward or below the nozzle entrance again. In general, the ink meniscus 504 oscillates in an advancing and retreating manner until the ink in the chamber 118 settles.

Changes in impedance can be measured across nozzle 102 between conductor traces 120*a* and 120*b* as an ink droplet 101 is ejected and as the ink meniscus 504 oscillates back and forth during the refilling of the chamber 118 with ink. FIG. 6 illustrates an example plot 600 of the current that flows between or through conductor traces 120*a* and 120*b*, versus time, before, during and after and ink drop ejection, according to an embodiment. The amount of current flow through traces 120*a* and 120*b* is arbitrarily dependent on the voltage potential at conductor trace 120*b*, and the impedance at any moment is readily determined from the current and the voltage at conductor race 120*b*. The health or proper functioning of a nozzle 102 can be established, for example, when the change in impedance measured across the nozzle 102 (i.e., between conductor traces 120*a* and 120*b*) exceeds a preset threshold. Conversely, it can be determined that a nozzle 102 is not healthy (i.e., not functioning properly) when there is not a change in impedance measured across the nozzle 102 that exceeds an expected preset threshold during a scheduled drop ejection event.

The plot 600 of FIG. 6 corresponds with the series of illustrations A-F in FIG. 5 showing a drop 101 of fluid being ejected from an inkjet printhead 100. Point A on plot 600 corresponds with illustration A of FIG. 5. At point A (i.e., time zero on plot 600), the process of ejecting a drop 101 has not yet begun, and there is no ink in the nozzle 102. With no ink in the nozzle 102, the gap between conductor traces 120*a* and 120*b* has virtually an infinite impedance and acts as an open circuit. Accordingly, the plot 600 shows at point A (i.e., time zero) that no current is flowing through the conductor traces 120*a* and 120*b*.

Point B on plot 600 corresponds with illustration B of FIG. 5. At point B, an expanding vapor bubble 502 in chamber 118 has pushed ink into the nozzle and is forcing the ink out the other side of the nozzle 102. The ink acts as a conductor between traces 120*a* and 120*b*, and the impedance between the traces 120*a* and 120*b* is minimized because the nozzle 102 is completely filled with ink. Therefore, between points A and B on the plot 600 (i.e., between about zero and 10 milliseconds), the current flow increases dramatically as the nozzle 102 fills with ink, and at point B the current flows at a maximum between the traces 120*a* and 120*b* through the ink in the nozzle 102. Point C on plot 600 corresponds with illustration C of FIG. 5. At point C, the ink droplet 101 has cleared the nozzle 102, leaving the nozzle empty of ink and creating a void of ink in chamber 118. Therefore, the impedance between the traces 120*a* and 120*b* is again near a maximum because the nozzle 102 is empty of ink. As shown between points B and C on the plot 600 (i.e., between about 10 and 20 milliseconds), the current flow decreases dramatically as the nozzle 102 empties of ink, and at point C the current flow is again near a minimum between the traces 120*a* and 120*b*.

Once the ink droplet 101 is ejected from nozzle 102, the chamber 118 immediately begins refilling again with ink. Point D on plot 600 corresponds with illustration D of FIG. 5, and at point D the chamber has already begun being refilled with ink. However, at point D there is still little or no ink in the nozzle 102, so the impedance between conductor traces 120*a* and 120*b* remains high and the current flow between the traces 120*a* and 120*b* remains near a minimum. Point E on plot 600 corresponds with illustration E of FIG. 5. At point E, the impedance between conductor traces 120*a* and 120*b* decreases as the momentum of the ink refilling chamber causes the ink meniscus 504 to advance somewhat into the nozzle 102. Thus, the current flow between the traces 120*a* and 120*b* increases. As the chamber 118 is refilled and as the ink settles in the chamber, the ink meniscus 504 advances and retreats within the nozzle 102 in an oscillating manner. For example, at point F on plot 600, which corresponds with illustration F of FIG. 5, the ink meniscus 504 is retreating back toward the chamber 118. This leaves less ink in the nozzle 102 and results in a higher impedance between conductor traces 120*a* and 120*b*. Accordingly, point F on plot 600 shows a reduction in current flow. The current flow (and impedance) fluctuates up and down as shown in FIG. 6 until the ink has settled in the chamber 118, after which the current flow drops down again (not shown in FIG. 6).

Figure 7:
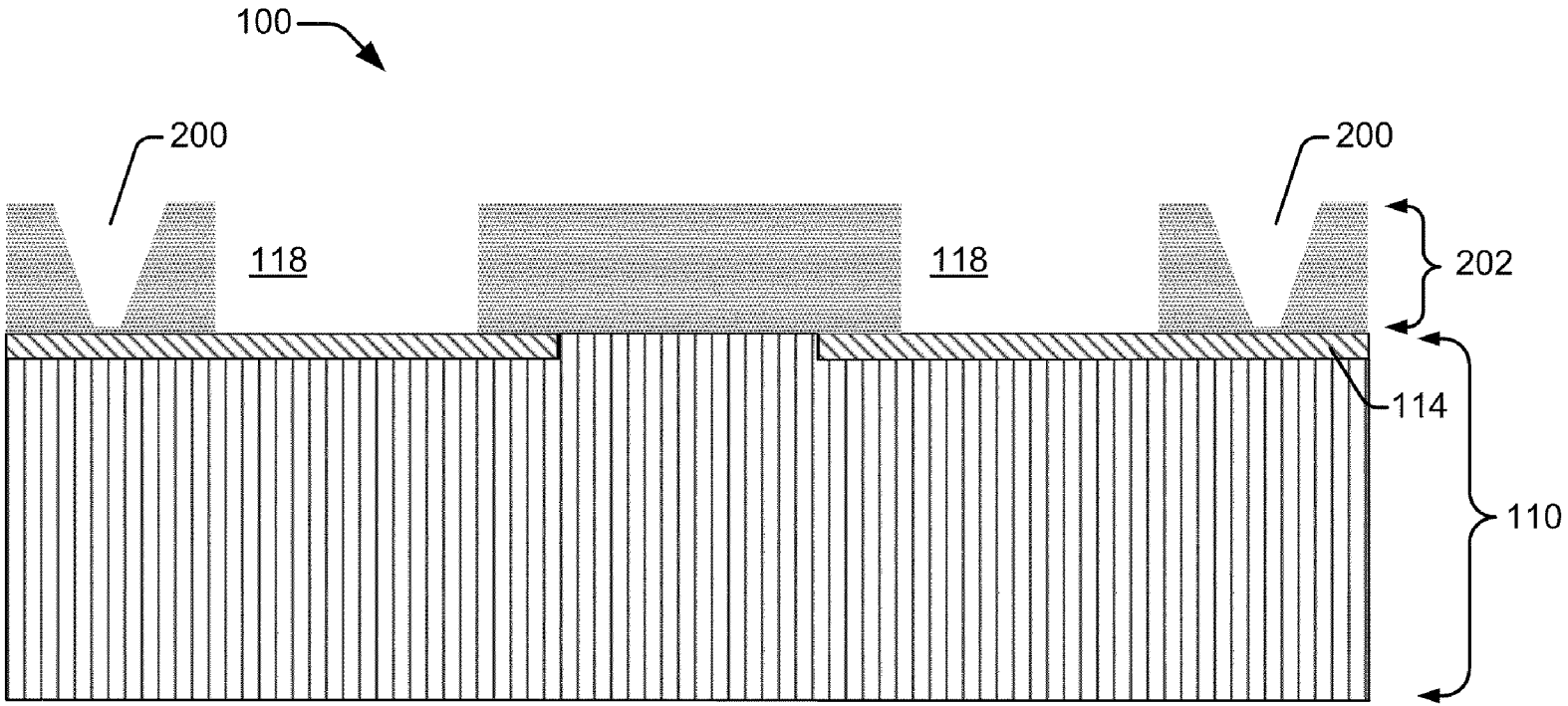
FIGS. 7-10 show an inkjet printhead in various phases of fabrication according to an embodiment.
Figure 8:
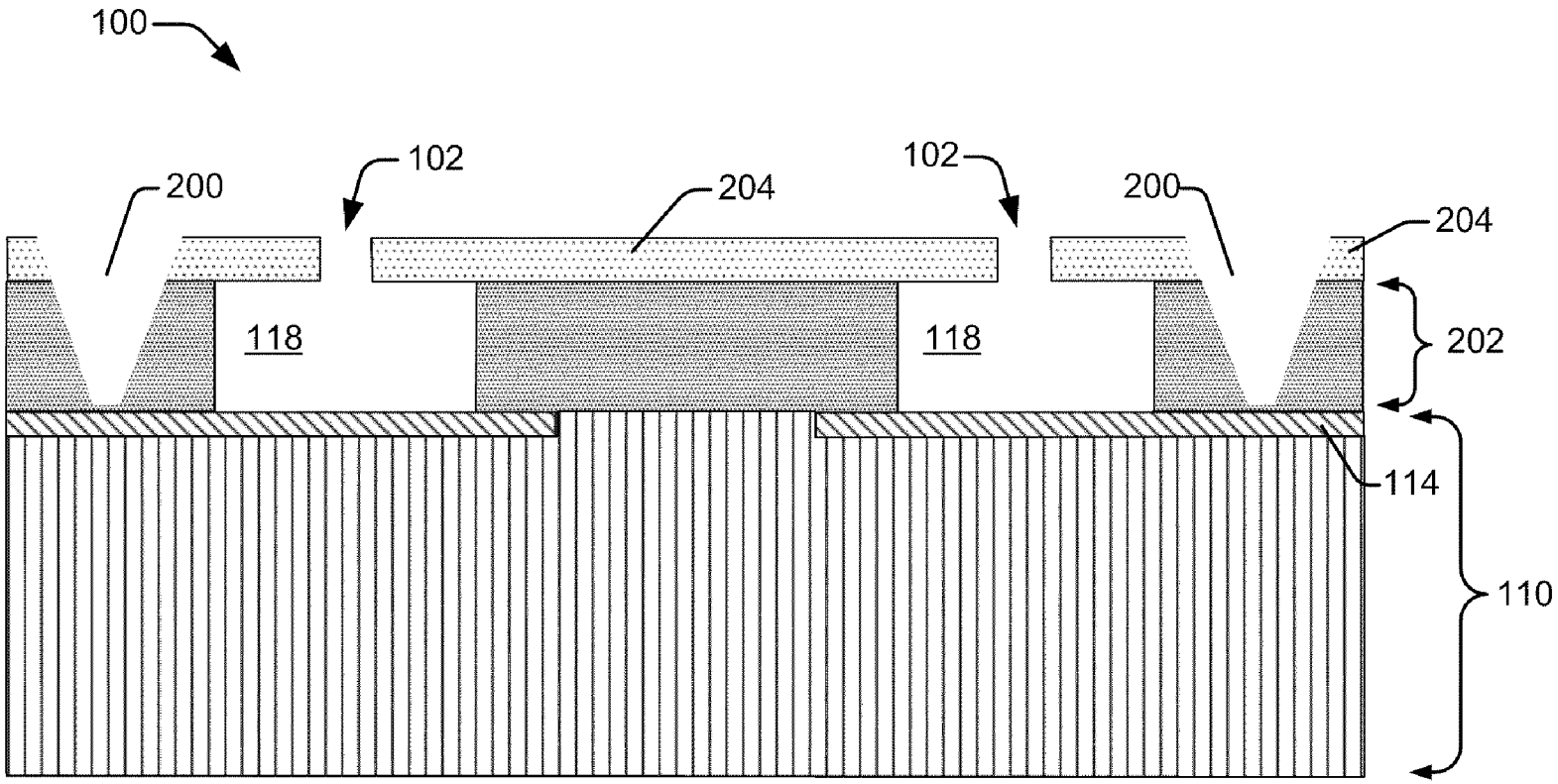

FIGS. 7-10 illustrate an inkjet printhead 100 in various phases of fabrication according to an embodiment. The fabrication of the inkjet printhead 100 can be performed using well-known circuit fabrication techniques such as photolithography. In FIG. 7, an SU8 chamber layer 202 is applied to a substrate 110 such as a silicon wafer. The SU8 chamber layer 202 forms one or more chamber 118 areas and one or more vias 200. Prior to the application of the SU8 chamber layer 202, an integrated circuit layer 114 has already been fabricated on the silicon substrate 110 through well-known techniques such as photolithography. The SU8 chamber layer 202 can be applied to the substrate, for example, through spin-coating. In FIG. 8, a top hat layer 204 is applied over the SU8 chamber layer 202. The top hat layer 204 can be applied, for example, as a laminate dry film SU8 top hat layer 204 through known circuit fabrication and photolithographic techniques. Application of the SU8 top hat layer 204 forms nozzle openings 102 over respective chambers 118 and may further form the vias 200 to extend through the SU8 top hat layer 204. Together, the chamber layer 202 and top hat layer 204, may in some embodiments be referred to as SU8 orifice layer 112.

Figure 9:
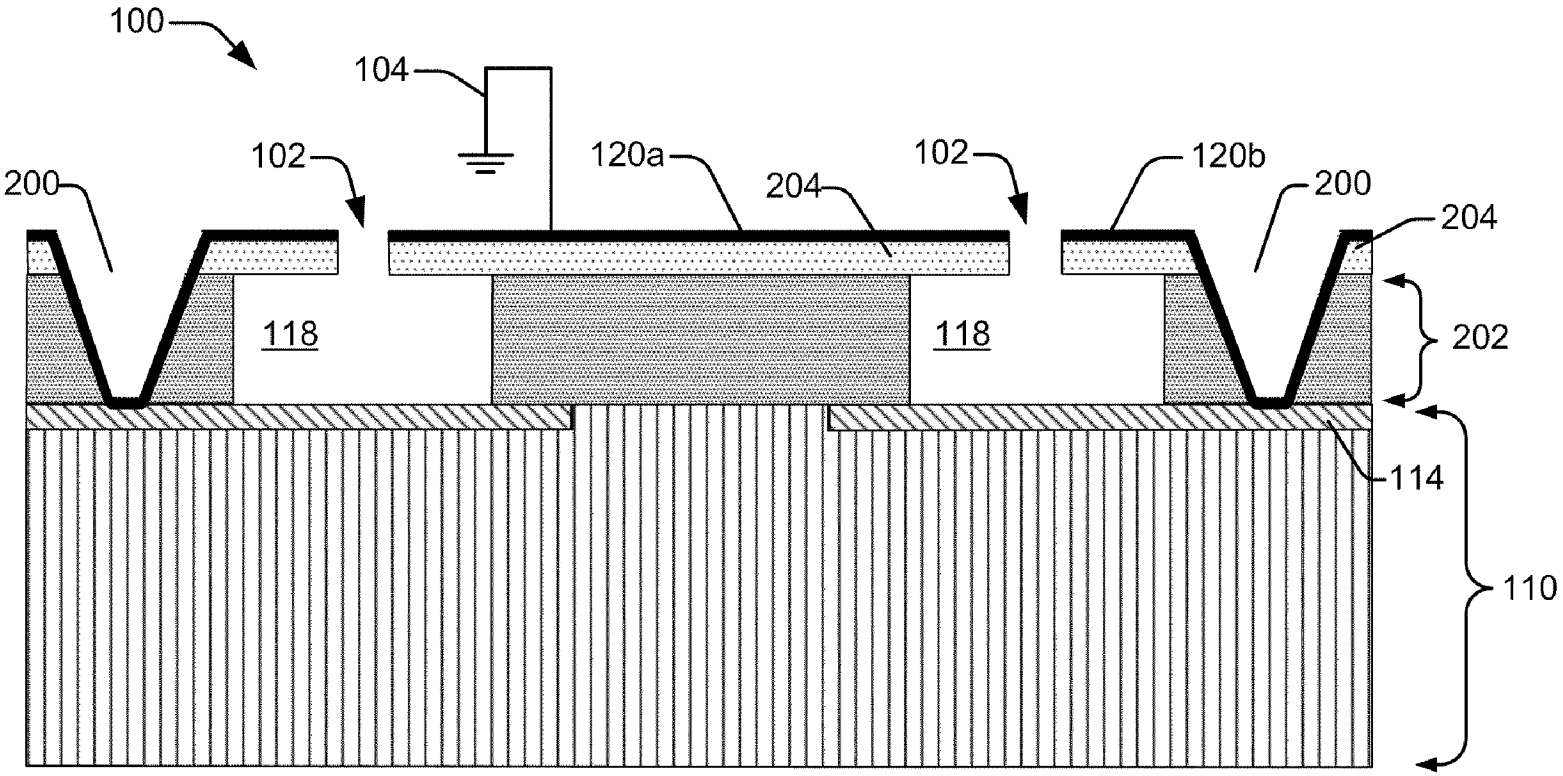

In FIG. 9, a metal trace referred to as a conductor trace 120 is applied on top of the SU8 top hat layer 204, for example, through known circuit fabrication and photolithographic techniques. The metal conductor trace 120 is broken at the point of its intersection with a nozzle 102 such that one end of a first conductor trace 120*a* intersects the nozzle 102 at one edge of the nozzle 102, and another end of the first conductor trace 120*a* is coupled to ground 104, such as a ground on integrated circuitry layer 114 or a ground at the edge of the printhead die (not shown), A second conductor trace 120*b* also intersects the nozzle 102 and is coupled to a fixed potential, such as on the integrated circuit layer 114 or at the edge of the die.

Figure 10:
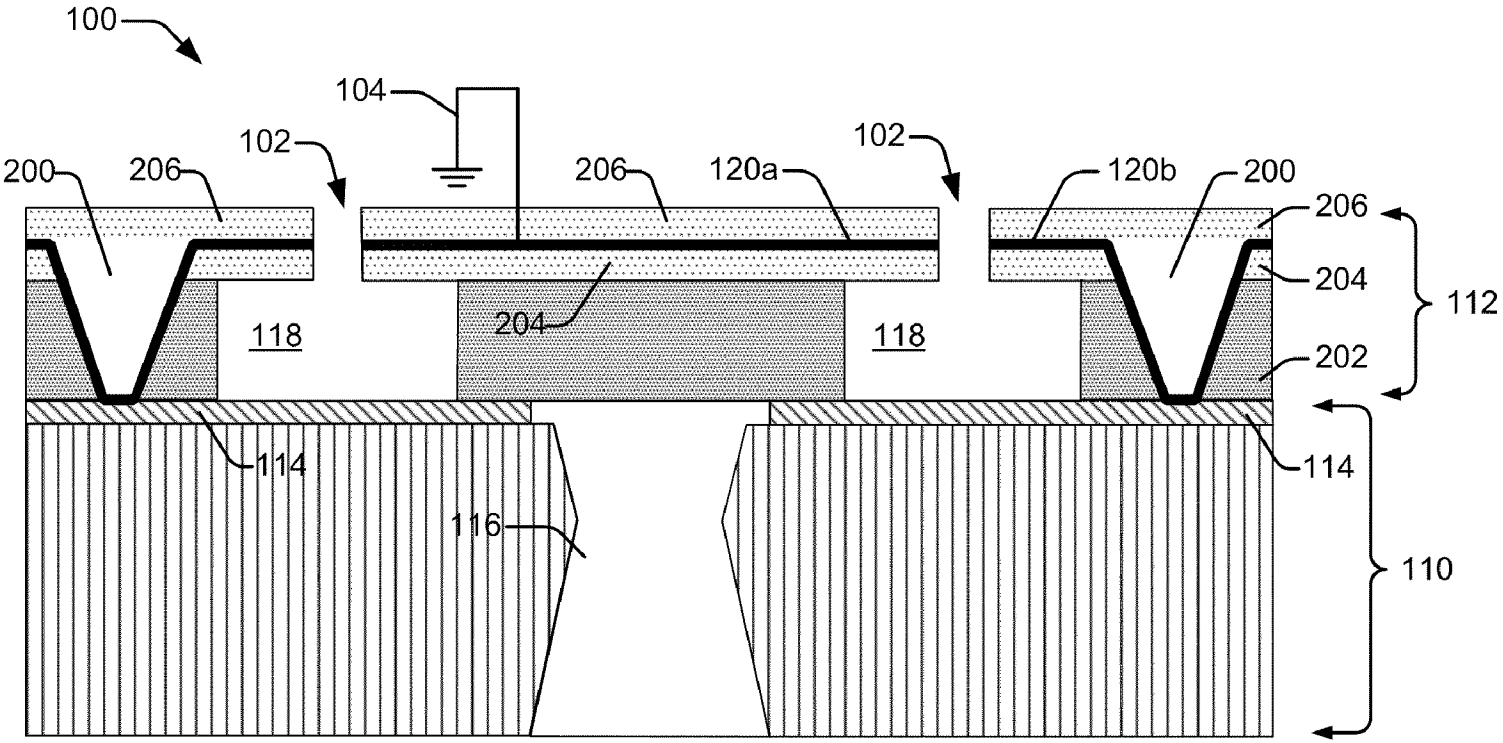

In FIG. 10, a cap layer 206 is applied over the top hat layer 204. The cap layer 206 can be applied, for example, as a laminate dry film SU8 cap layer 206. Together, the chamber layer 202, top hat layer 204 and cap layer 206, may in some embodiments be referred to as SU8 orifice layer 112. Application of the cap layer 206 embeds the conductor trace 120 in the SU8 orifice layer 112. FIG. 10 further illustrates additional fabrication of the substrate 110 to include an ink channel 116 for supplying ink or other fluid to the SU8 orifice layer 112 and nozzle(s) 102.

Figure 11:
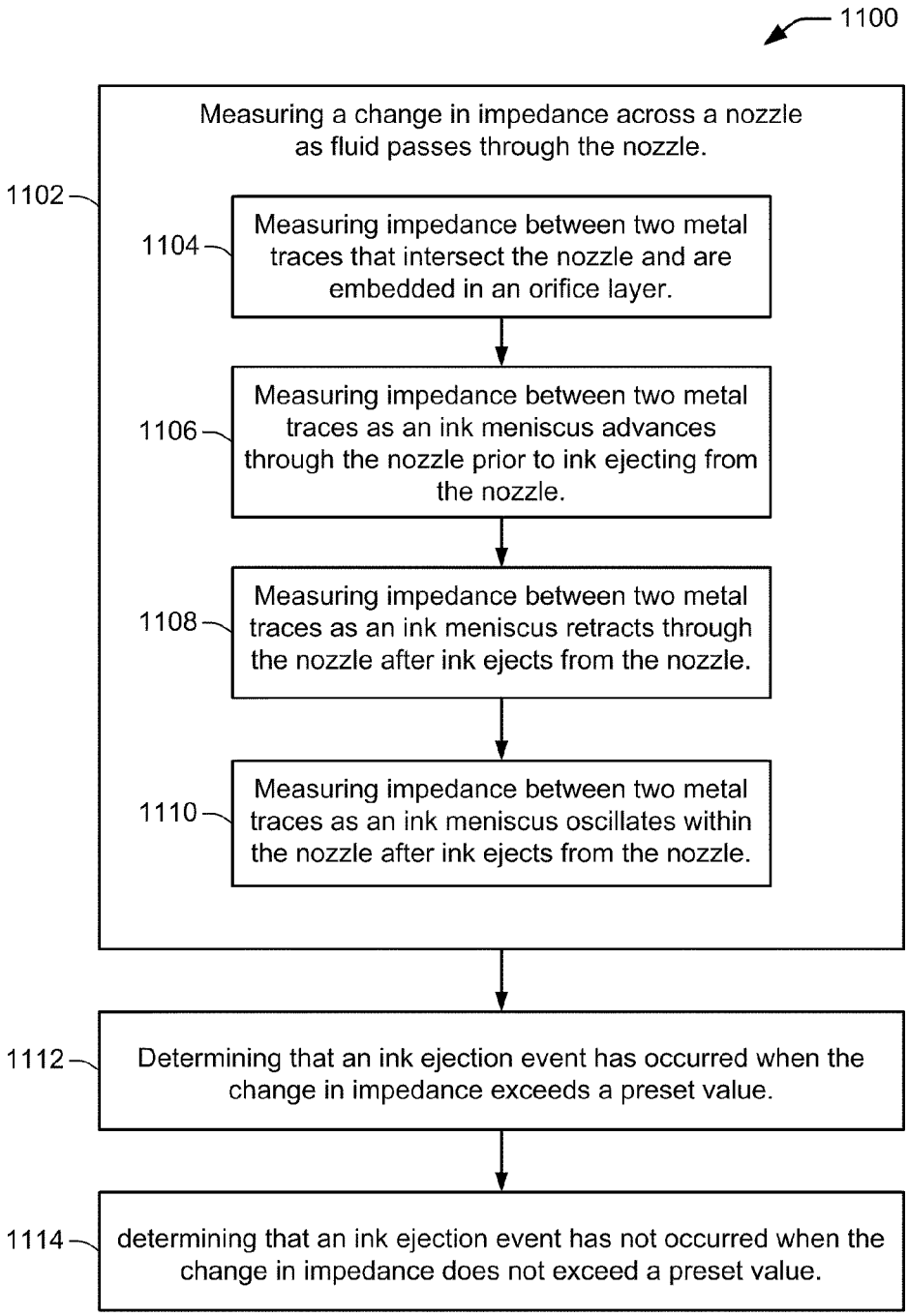
FIG. 11 shows a flowchart of a method of determining a healthy fluid ejection nozzle, according to an embodiment.

FIG. 11 shows a flowchart of a method 1100 of determining a healthy fluid ejection nozzle, according to an embodiment. Method 1100 is associated with the embodiments of an inkjet printhead 100 illustrated in FIGS. 1-10 and the related description above. In general, method 1100 provides for a performance-based maintenance that monitors nozzle health during nozzle operation through measuring changes in impedance across the nozzle as fluid passes through the nozzle. Thus, individual, non-functioning nozzles are detected in real time and can be compensated for during printing through, for example, turning on redundant nozzles or increasing the output of adjacent nozzles.

Method 1100 begins at block 1102 with measuring a change in impedance across the nozzle as fluid passes through the nozzle. As shown in block 1104, measuring a change in impedance across the nozzle can include measuring impedance between two metal traces that intersect the nozzle and are embedded in an orifice layer. One of the metal traces intersecting the nozzle may be coupled to ground, while the other of the metal traces intersecting the nozzle may be coupled to a voltage potential and additional diagnostic circuitry, such as on a circuit layer formed on a silicon substrate.

At block 1106 of method 1100, measuring a change in impedance across the nozzle can include measuring impedance between two metal traces as an ink meniscus advances through the nozzle prior to ink ejecting from the nozzle. As shown at block 1108, measuring a change in impedance across the nozzle can include measuring impedance between two metal traces as an ink meniscus retracts through the nozzle after ink ejects from the nozzle. Measuring a change in impedance across the nozzle can also include measuring impedance between two metal traces as an ink meniscus oscillates within the nozzle after ink ejects from the nozzle, as shown at block 1110.

The method 1100 of determining a healthy fluid ejection nozzle continues at block 1112 with determining that an ink ejection event has occurred when the change in impedance exceeds a preset value. As noted above with reference to FIGS. 5 and 6, the amount of current flow through traces 120*a* and 120*b* is arbitrarily dependent on the voltage potential at conductor trace 120*b*, and the impedance at any moment is readily determined from the current and the voltage at conductor trace 120*b*. Diagnostic circuitry, such as on a circuit layer 114 formed on a silicon substrate 110 may be readily designed by techniques well-known to those skilled in the art which determines changes in impedance, such as impedance changes sensed across a nozzle 102, and compares the impedance changes to a threshold to determine if a preset value is exceeded. At block 1114 of method 1100, determining a healthy fluid ejection nozzle may also include determining that an ink ejection event has not occurred when the change in impedance does not exceed a preset value.

What is claimed is:

1. A method of determining a healthy fluid ejection nozzle comprising, as fluid passes through the nozzle and between two metal traces whose termini intersect single points at inside edges of the nozzle, measuring a change in impedance within the nozzle between the two metal traces as the fluid passes between the metal trace termini.

2. A method as recited in claim 1, wherein the metal traces extend away from the nozzle through an orifice layer that forms the nozzle, and in a direction orthogonal to the direction the fluid passes through the nozzle.

3. A method as recited in claim 1, wherein measuring comprises measuring impedance as an ink meniscus advances through the nozzle prior to ink ejecting from the nozzle.

4. A method as recited in claim 1, wherein measuring comprises measuring impedance as an ink meniscus retracts through the nozzle after ink ejects from the nozzle.

5. A method as recited in claim 1, wherein measuring comprises measuring impedance as an ink meniscus oscillates within the nozzle after ink ejects from the nozzle.

6. A method as recited in claim 1, further comprising determining that an ink ejection event has occurred when the change in impedance exceeds a preset range.

7. A method as recited in claim 1, further comprising determining that an ink ejection event has not occurred when the change in impedance does not exceed a preset range.

8. A printhead comprising:

a first metal trace having a terminus intersecting an inside edge of an ink nozzle;

a second metal trace having a terminus intersecting the inside edge of the ink nozzle and another terminus coupled to ground; and an integrated circuit coupled to the first metal trace to sense a change in impedance within the nozzle between the two metal traces as the fluid passes between the metal trace termini intersecting the inside edge of the ink nozzle.

9. A printhead as recited in claim 8, further comprising an orifice layer including an ink chamber and the nozzle, wherein the metal traces are embedded in the orifice layer.

10. A printhead as recited in claim 9, further comprising a via formed in the orifice layer through which the first metal trace extends between the nozzle and the integrated circuit on a silicon substrate.

11. A printhead as recited in claim 8, wherein the orifice layer comprises an SU8 orifice layer.

* * * * *